US010245593B2

(12) United States Patent
Wallin

(10) Patent No.: US 10,245,593 B2
(45) Date of Patent: Apr. 2, 2019

(54) AIR-FILTER ARRANGEMENT

(71) Applicant: Elfi Elektrofilter Aktiebolag, Alingsås (SE)

(72) Inventor: Jan-Olof Wallin, Alingsås (SE)

(73) Assignee: Elfi Elektrofilter Aktiebolag (SE)

( * ) Notice: Subject to any disclaimer, the term of this patent is extended or adjusted under 35 U.S.C. 154(b) by 181 days.

(21) Appl. No.: 15/317,822

(22) PCT Filed: Jun. 3, 2015

(86) PCT No.: PCT/EP2015/062387

§ 371 (c)(1),
(2) Date: Dec. 9, 2016

(87) PCT Pub. No.: WO2015/189081

PCT Pub. Date: Dec. 17, 2015

(65) Prior Publication Data

US 2017/0120254 A1 May 4, 2017

(30) Foreign Application Priority Data

Jun. 9, 2014 (EP) ..... 14171666

(51) Int. Cl.
*B03C 3/12* (2006.01)
*B03C 3/28* (2006.01)
(Continued)

(52) U.S. Cl.
CPC ..... *B03C 3/12* (2013.01); *B03C 3/155* (2013.01); *B03C 3/28* (2013.01); *B03C 3/368* (2013.01); *B03C 3/41* (2013.01)

(58) Field of Classification Search
CPC combination set(s) only.
See application file for complete search history.

(56) References Cited

U.S. PATENT DOCUMENTS 5,593,476 A * 1/1997 Coppom ..... B03C 3/155 95/78
7,132,010 B2 * 11/2006 Carlsson ..... B03C 3/155 96/55

(Continued)

FOREIGN PATENT DOCUMENTS

CN 2229049 Y 6/1996
CN 1886199 A 12/2006

(Continued)

OTHER PUBLICATIONS

International Search Report and Written Opinion for PCT/EP2015/062387 dated Aug. 7, 2015.

(Continued)

*Primary Examiner* — Duane Smith
*Assistant Examiner* — Sonji Turner
(74) *Attorney, Agent, or Firm* — Lerner, David, Littenberg, Krumholz & Mentlik, LLP

(57) ABSTRACT

An air filter arrangement is provided for filtration of particles in an airflow having an airflow direction. The air filter arrangement includes an electrostatically charged filter, a first ionization device, and a second ionization device. The first ionization device is arranged upstream of the electrostatically charged filter and the second ionization device is arranged downstream of the electrostatically charged filter. An air filtering apparatus is also described.

9 Claims, 1 Drawing Sheet

(51) Int. Cl.

| | |
|---|---|
| ***B03C 3/41*** | (2006.01) |
| ***B03C 3/155*** | (2006.01) |
| ***B03C 3/36*** | (2006.01) |

(56) References Cited

U.S. PATENT DOCUMENTS

| | | | | |
|---|---|---|---|---|
| 7,258,729 | B1 * | 8/2007 | Barsimanto | B03C 3/09 96/226 |
| 7,279,028 | B2 | 10/2007 | Bergeron et al. | |
| 7,452,410 | B2 * | 11/2008 | Bergeron | A61L 9/205 95/57 |
| 2005/0109204 | A1 | 5/2005 | Coppom et al. | |
| 2007/0137486 | A1 | 6/2007 | Bergeron et al. | |
| 2008/0156186 | A1 * | 7/2008 | McKinney | B03C 3/09 95/2 |
| 2011/0219954 | A1 | 9/2011 | McKinney | |

FOREIGN PATENT DOCUMENTS

| | | | | |
|---|---|---|---|---|
| GB | 2308320 | A | 6/1997 | |
| WO | 9609118 | A1 | 3/1996 | |
| WO | WO-9609118 | A1 * | 3/1996 | B03C 3/155 |
| WO | 9723294 | A1 | 7/1997 | |
| WO | 2015189081 | A1 | 12/2015 | |

OTHER PUBLICATIONS

Chinese Search Report for Application No. CN201580030774.1 dated Jul. 21, 2017.

* cited by examiner

AIR-FILTER ARRANGEMENT

CROSS REFERENCE TO RELATED APPLICATIONS

This application is a national phase entry under 35 U.S.C. § 371 of International Application No. PCT/EP2015/062387, filed Jun. 3, 2015, published in English, which claims the benefit of the filing date of European Patent Application No. 14171666.2, filed Jun. 9, 2014, the disclosures of which are hereby incorporated herein by reference.

TECHNICAL FIELD

The present disclosure relates to an air filter arrangement. The present disclosure also relates to an air filtering apparatus.

BACKGROUND

Particulate matter (PM), also known as particulates, are tiny pieces of solid or liquid matter in air. Such particulate matter may comprise bacteria, mold spores, pollen, house dust mite allergens, viruses, dust, smog, tobacco smoke, etc. Inhaling of particulate matter has shown to cause negative health effects on humans and animals and major health benefits can be achieved by reducing particulate matter in the air. Air filter arrangements are used in a wide variety of environments to remove particulate matter in order to purify air. Though there exist several types of air-filtration technologies, electrostatic filters have become increasingly popular because of their high efficiency. For example, the document US 20070137486 A1 describes an electrostatic filter.

Further, the document US 2011/0219954 A1 relates to an electrically enhanced air filtration system which uses rear fiber charging. In particular, a fibrous filter may be placed in an upstream position within the system with one or more ionization arrays positioned downstream or to the rear of the fibrous filter in terms of airflow direction. The fibrous filter may include a grounded side and fiber side with the grounded side being upstream of the fiber side. The ionization array may include a plurality of electrodes each extending unidirectionally toward the fibrous filter. The document GB 2308320 A relates to an air filtration apparatus comprising an inlet, an outlet, a fan, a corona discharge cell and an electret filter e.g. polypropylene. In another embodiment, two discharge cells are provided in sequence, and two electret filters the first being thicker than the second. The return current from the filter element can be measured to give an indication of levels of pollutant particles present, the indication being used to control the speed of the fan and show when the filter needs to be replaced. The document WO 9609118 A1 relates to an electro-mechanical electrostatic air cleaner that combines a low air resistance dielectric fibrous filter material such as polyester or glass which is positioned between and electrically charged by two electrically resistant carbon coated screens encased in an electrically insulated frame. The screens are charged by a remotely mounted bi-polar power supply.

An electrostatic filter works with the principle that portions of the electrostatic filter having a certain electrostatic charge attract particles in the air. Thereby, an electrostatic filter may have a higher particulate capturing capability than an ordinary filter without portions having an electrostatic charge. However, the electrostatic charge of an electrostatic filter may decline over time, for several reasons. Thus, also a particulate capturing capability of such an electrostatic filter may decline over time. Further, some air filtering apparatuses utilize filters having relative dense filter media. Due to the relative dense filter media, such filters will have a relatively high flow resistance. As a result, a considerable amount of electrical energy will be required to drive a fan forcing ambient air through such a filter. Also, it is likely that such an arrangement will produce a considerable amount of noise.

Accordingly, in view of the prior art arrangements, there is a need for an improved air filter arrangement.

SUMMARY

An object of the present disclosure is to provide an improved air filter arrangement, or at least to provide a useful alternative.

According to an aspect of the present disclosure, the object is achieved by an air filter arrangement for filtration of particles in an airflow having an airflow direction, the air filter arrangement comprising an electrostatically charged filter, a first ionisation device, and a second ionisation device, wherein the first ionisation device is arranged upstream of the electrostatically charged filter and the second ionisation device is arranged downstream of the electrostatically charged filter.

Since the air filter arrangement comprises an electrostatically charged filter, a first ionisation device, and a second ionisation device, wherein the first ionisation device is arranged upstream of the electrostatically charged filter and the second ionisation device is arranged downstream of the electrostatically charged filter, a change in electrical potential of the electrostatically charged filter caused by particles ionised by the first ionisation device ending up in the filter will be compensated by the effect of the second ionisation device. Thereby, the electrostatic charge of the electrostatically charged filter can be maintained over time, and thus also the particulate capturing capability of the electrostatically charged filter.

As a result, since the particulate capturing capability can be maintained over time, an air filter arrangement having an improved particulate capturing capability is provided.

Accordingly, the above mentioned object is achieved.

Further, since the particulate capturing capability can be maintained over time, and since an improved particulate capturing capability is provided, a lifespan of the electrostatically charged filter may be increased, an electrostatically charged filter having less dense filter media may be used and/or a less costly electrostatically charged filter may be used.

Optionally, the first ionisation device is arranged to ionize particles in the airflow. Since the ionisation device is arranged to ionize particles in the airflow, the filter arrangement will have an improved particulate capturing capability since particles in the airflow will, as a result of being ionized, have a charge and will as a result thereof be attracted to each other to thereby form larger groups of particles. Such larger groups of particles will be easier to capture in the electrostatically charged filter. As a further result of being ionized and receiving a charge, the particles will be easier to capture in the electrostatically charged filter since the particles will be attracted to electrostatically charged filter media of the electrostatically charged filter.

Due to the improved particulate capturing capability, an electrostatically charged filter having a lower flow resistance can be used while the particulate capturing capability is maintained. Thereby, a fan of an air filtering apparatus comprising an air filter arrangement provided will require less electrical energy and such an air filtering apparatus will also make less noise.

The electrostatically charged filter is electrically isolated from an environment external to the electrostatically charged filter. Thereby, the electrostatic charge in the electrostatically charged filter can be maintained. Since the filter is electrically isolated, it is not connected to earth or ground.

Optionally, the second ionisation device is arranged to support an electrostatic charge of the electrostatically charged filter. Thereby, the electrostatic charge of the electrostatically charged filter can be maintained over time. As a result, particulate capturing capability of the air filter arrangement can also be maintained over time.

Optionally, the second ionisation device is arranged to generate an ion current at least partially directed towards the electrostatically charged filter to thereby support the electrostatic charge of the electrostatically charged filter. Thereby, the electrostatic charge of the electrostatically charged filter can be maintained in an easy and reliably manner. Thereby, the electrostatic charge of the electrostatically charged filter can be maintained over time. As a result, particulate capturing capability of the air filter arrangement can be maintained over time.

Optionally, the first ionisation device and the second ionisation device have mutually opposite polarity. Since the first ionisation device and the second ionisation device have mutually opposite polarity, electrostatic charge of the electrostatically charged filter can be maintained over time. As a further result, particulate capturing capability of the air filter arrangement will also be maintained over time Optionally, the first ionisation device comprises a first ionisation electrode and a second ionisation electrode, wherein the first ionisation electrode and the second ionisation electrode of said first ionization device have mutually opposite polarity.

Optionally, the second ionisation device comprises a first ionisation electrode and a second ionisation electrode, wherein the first ionisation electrode and the second ionisation electrode of said second ionization device have mutually opposite polarity.

Optionally, the electrostatically charged filter comprises a fibrous material such as a fibrous polymer. Since the electrostatically charged filter comprises a fibrous material, such as a fibrous polymer, the particulate capturing capability of the electrostatically charged filter may be improved. Also, maintaining of electrostatic charge of the electrostatically charged filter may be facilitated.

According to an aspect of the present disclosure, the object is achieved by an air filtering apparatus comprising an air filter arrangement according to some embodiments of the present disclosure. Since the air filtering apparatus comprises an air filter arrangement which allows for the use of an electrostatically charged filter having a low flow resistance, an air filtering apparatus is providing allowing a low electrical energy consumption and/or low noise level.

Further features of, and advantages with, the present disclosure will become apparent when studying the appended claims and the following detailed description. Those skilled in the art will realize that the different features described may be combined to create embodiments other than those described in the following, without departing from the scope of the present disclosure, as defined by the appended claims.

BRIEF DESCRIPTION OF THE DRAWINGS

The various aspects of the present disclosure, including its particular features and advantages, will be readily understood from the following detailed description and the accompanying drawings, in which.

DETAILED DESCRIPTION

The embodiments herein will now be described more fully with reference to the accompanying drawings, in which example embodiments are shown. Disclosed features of example embodiments may be combined as readily understood by one of ordinary skill in the art. Like numbers refer to like elements throughout.

Well-known functions or constructions will not necessarily be described in detail for brevity and/or clarity.

Figure 1:
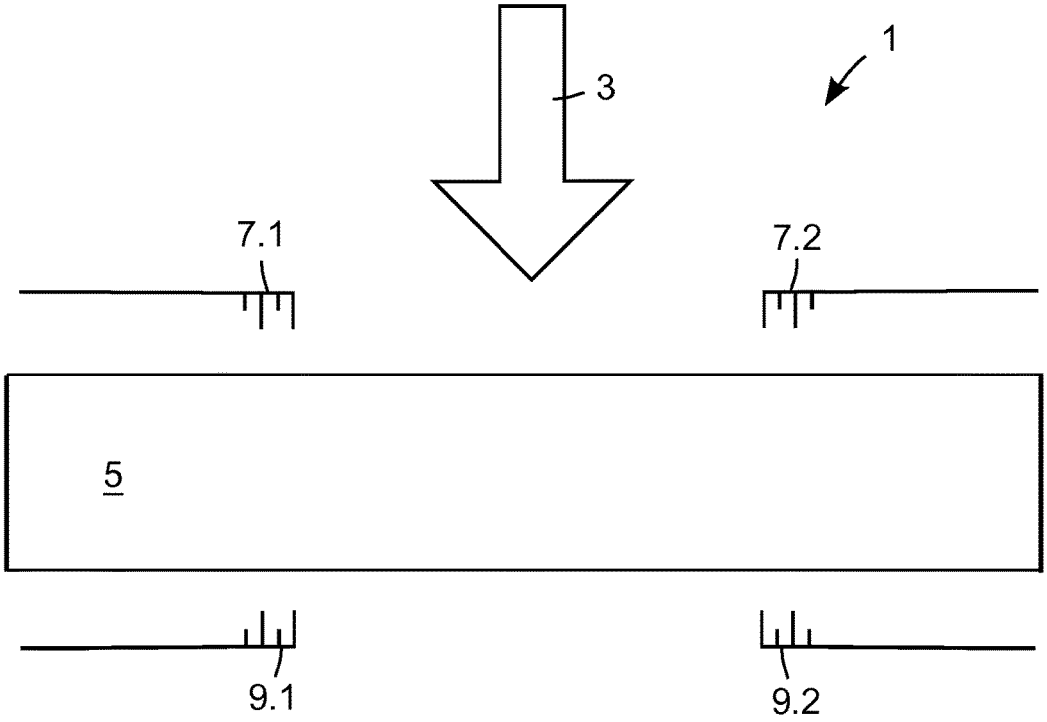
FIG. 1 illustrates an air filter arrangement.

FIG. 1 illustrates an air filter arrangement 1 for filtration of particles in an airflow having an airflow direction 3. The air filter arrangement comprises an electrostatically charged filter 5, a first ionisation device 7.1, 7.2, and a second ionisation device 9.1, 9.2. The first ionisation device 7.1, 7.2 is arranged upstream of the electrostatically charged filter 5 and the second ionisation device 9.1, 9.2 is arranged downstream of the electrostatically charged filter 5.

The electrostatically charged filter 5 may comprise a fibrous material such as a fibrous polymer. The fibrous polymer may for example comprise a synthetic polymer such as fluoropolymers, polypropylene, or polyethylene terephthalate. The electrostatically charged filter 5 may be an electrostatically pre-charged filter 5. Thus, the electrostatically charged filter 5 may have received it's electrostatically charge in a manufacturing step of said electrostatically charged filter 5. Accordingly the electrostatically charged filter 5 may have received it's electrostatically charge before being arranged in an air filer arrangement 1 provided and thus also may have received it's electrostatically charge before being arranged in an air filtering apparatus 11 provided. The electrostatically charged filter 5 may comprise a dielectric material that has a quasi-permanent electric charge or dipole polarisation. The electrostatically charged filter 5 may comprise one or more of positive excess charges, negative excess charges and oriented dipoles. The electrostatically charged filter 5 may comprise portions with different charge. That is, a portion of the electrostatically charged filter 5 may have a positive charge, and an adjacent portion, a negative charge. A fibre in the electrostatically charged filter 5 may have a charge which varies along an extension of said fibre.

The first ionisation device 7.1, 7.2 is arranged to ionize particles in the airflow. Since the ionisation device 7.1, 7.2 is arranged to ionize particles in the airflow, the filter arrangement 1 will have an improved particulate capturing capability since particles in the airflow will, as a result of being ionized, have an electrical charge and will as a result thereof be attracted to each other to thereby form larger groups of particles, which will be easier to capture in the electrostatically charged filter 5. The particles will also be easier to capture in the electrostatically charged filter 5 since the electrically charged particles will be attracted to portions of the electrostatically charge filter media of the electrostatically charged filter 5 having opposite polarity.

The electrostatically charged filter 5 is electrically isolated from an environment external to the electrostatically charged filter 5. Thereby, the electrostatic charge in the electrostatically charged filter 5 will be maintained.

The second ionisation device 9.1, 9.2 is arranged to support an electrostatic charge of the electrostatically charged filter 5.

Particles ionised by the first ionisation device 7.1, 7.2 which end up in the electrostatically charged filter 5 may over time cause a change in electrical potential of the electrostatically charged filter 5. However, this may be compensated by the effect of the second ionisation device 9.1, 9.2. Thereby, the electrostatic charge of the electrostatically charged filter 5 can be maintained over time. As a result, particulate capturing capability of the air filter arrangement 1 may be maintained over time.

The second ionisation device 9.1, 9.2 may be arranged to generate an ion current at least partially directed towards the electrostatically charged filter 5 to thereby support the electrostatic charge of the electrostatically charged filter 5.

The second ionisation device 9.1, 9.2 may be arranged to support an electrostatic charge of the electrostatically charged filter 5 in an intermittent manner. Thus, the second ionisation device 9.1, 9.2 may be arranged to generate an ion current in an intermittent manner such that the ion current is generated in pulses. Duration of such a pulse may for example be a couple of minutes and a length between two of such pulses may for example be a couple of hours or even up to 48 hours, depending upon the design of the air filter arrangement 1.

The first ionisation device 7.1, 7.2 and the second ionisation device 9.1, 9.2 may have mutually opposite polarity. According to some embodiments, the first ionisation device 7.1, 7.2 has a positive polarity and the second ionisation device 9.1, 9.2 has a negative polarity. According to other embodiments, the first ionisation device 7.1, 7.2 has a negative polarity and the second ionisation device 9.1, 9.2 has a positive polarity.

The first ionisation device 7.1, 7.2 and the second ionisation device 9.1, 9.2 may each generate an ion current being at least partially directed towards the electrostatically charged filter 5, where these ion currents have mutually opposite polarity. As a result, the electrostatic charge of the electrostatically charged filter 5 will be maintained over time. As a further result, particulate capturing capability of the air filter arrangement 1 will be maintained over time.

The first ionisation device 7.1, 7.2 may comprise a first ionisation electrode 7.1 and a second ionisation electrode 7.2 wherein the first ionisation electrode 7.1 and the second ionisation electrode 7.2 have mutually opposite polarity.

Further, the second ionisation device 9.1, 9.2 may comprise a first ionisation electrode 9.1 and a second ionisation electrode 9.2 where the first ionisation electrode 9.1 and the second ionisation electrode 9.2 have mutually opposite polarity.

The first ionisation device 7.1, 7.2 and the second ionisation device 9.1, 9.2 may each comprise one or more of a carbon brush, a tip, or a wire connected to a voltage supply. Such a voltage supply may supply a negative or a positive voltage in the range from 2 V to 20,000 V, or in the range from 2,000 V to 20,000 V.

Figure 2:
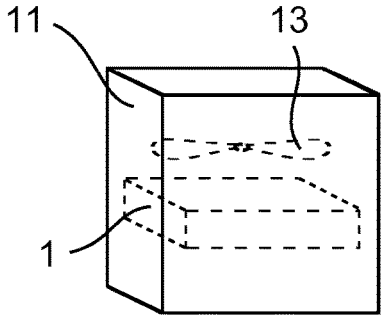
FIG. 2 illustrates an air filtering apparatus.

FIG. 2 illustrates an air filtering apparatus 11 comprising an air filter arrangement 1 according to some embodiments of the present disclosure. As illustrated in FIG. 2, the air filtering apparatus 11 may comprise a fan 13 arranged to force air through the air filter arrangement 1. Since the air filter arrangement 1 allows for the use of an electrostatically charged filter 5 having a low flow resistance, electrical energy required to drive the fan 13 may be low. As a further result, the air filtering apparatus 11 may produce low noise level.

It is to be understood that the foregoing is illustrative of various example embodiments and the present disclosure is not to be limited to the specific embodiments disclosed and that modifications to the disclosed embodiments, combinations of features of disclosed embodiments as well as other embodiments are intended to be included within the scope of the appended claims.

The invention claimed is:

1. An air filter arrangement for filtration of particles in an airflow having an airflow direction, said air filter arrangement comprising;

an electrostatically charged filter;

a first ionisation device; and a second ionisation device, wherein said first ionisation device is arranged upstream of said electrostatically charged filter and said second ionisation device is arranged downstream of said electrostatically charged filter, wherein said electrostatically charged filter is electrically isolated from an environment external to said electrostatically charged filter, wherein said first ionisation device comprises a first ionisation electrode and a second ionisation electrode, and wherein said first ionisation electrode and said second ionisation electrode of said first ionization device have mutually opposite polarities.

2. The air filter arrangement according to claim 1, wherein said first ionisation device is arranged to ionize particles in said airflow.

3. The air filter arrangement according to claim 1, wherein said second ionisation device is arranged to support an electrostatic charge of said electrostatically charged filter.

4. The air filter arrangement according to claim 1, wherein said second ionisation device is arranged to generate an ion current at least partially directed towards said electrostatically charged filter to thereby support said electrostatic charge of said electrostatically charged filter.

5. The air filter arrangement according to claim 1, wherein said first ionisation device and said second ionisation device have mutually opposite polarities.

6. The air filter arrangement according to claim 1, wherein said second ionisation device comprises a first ionisation electrode and a second ionisation electrode, and wherein said first ionisation electrode and said second ionisation electrode of said second ionization device have mutually opposite polarities.

7. The air filter arrangement according to claim 1, wherein said electrostatically charged filter comprises a fibrous material.

8. An air filtering apparatus comprising an air filter arrangement comprising:

an electrostatically charged filter;

a first ionisation device; and a second ionisation device, wherein said first ionisation device is arranged upstream of said electrostatically charged filter and said second ionisation device is arranged downstream of said electrostatically charged filter, and wherein said electrostatically charged filter is electrically isolated from an environment external to said electrostatically charged filter, wherein said first ionisation device comprises a first ionisation electrode and a second ionisation electrode, and wherein said first ionisation electrode and said second ionisation electrode of said first ionization device have mutually opposite polarities.

9. The air filter arrangement according to claim 1, wherein said electrostatically charged filter comprises a fibrous polymer.

* * * * *